United States Patent [19]

Ito

[11] Patent Number: 4,908,672

[45] Date of Patent: Mar. 13, 1990

[54] PAPER SIZE SELECTION APPARATUS FOR USE IN COPIER MACHINES

[75] Inventor: Masazumi Ito, Osaka, Japan

[73] Assignee: Minolta Camera Kabushiki Kaisha, Osaka, Japan

[21] Appl. No.: 152,546

[22] Filed: Feb. 5, 1988

[30] Foreign Application Priority Data

Jun. 5, 1987 [JP] Japan ..... 62-141874

[51] Int. Cl.[4] ..... G03G 21/00

[52] U.S. Cl. ..... 355/311; 271/9

[58] Field of Search ..... 355/3 SH, 14 SH, 311, 355/309; 271/9

[56] References Cited

U.S. PATENT DOCUMENTS

| | | | |
|---|---|---|---|
| 4,575,227 | 3/1986 | Ito et al. | 355/56 |
| 4,618,252 | 10/1986 | Hisajima et al. | 355/14 SH X |
| 4,647,188 | 3/1987 | Kimiya et al. | 355/55 |
| 4,669,858 | 6/1987 | Ito et al. | 355/14 SH X |
| 4,809,050 | 2/1989 | Ito | 355/311 X |

FOREIGN PATENT DOCUMENTS

| | | | |
|---|---|---|---|
| 57-167040 | 10/1982 | Japan | 355/311 |

*Primary Examiner*—Fred L. Braun

*Attorney, Agent, or Firm*—Burns, Doane, Swecker & Mathis

[57] ABSTRACT

A paper size selection apparatus for use in copier machines with a plurality of paper accommodating sections capable of accommodating papers of different size by which one paper accommodating section is selected out from the plurality of the paper accommodating sections in accordance with an automatic paper selection function in which a preferred paper size is determined from a document size detected as well as a magnification factor, a preferential paper selection function in which a previously memorized paper size is selected, and a manual paper selection function in which a preferred paper size is selected by a key manipulation. These three paper selection functions are called for by manipulation of the key in succession and in rotation.

8 Claims, 10 Drawing Sheets

PAPER SIZE SELECTION APPARATUS FOR USE IN COPIER MACHINES

BACKGROUND OF THE INVENTION

This invention relates generally to such copier machines as capable of executing automatic paper selection (APS) as well as manual paper selection, and more specifically it relates to such paper size selection device thereof, which is capable of executing both automatic and manual paper size selecting operations in rotation mode.

As the copier machine having said kind of automatic paper size selectional function, such a prior art copier machine is known, as having an automatic document feed apparatus which comprises a document mounting section and a document carrier section made integral with openable and reclosable cover means, said automatic document feed apparatus being called hereinafter only briefly as "ADF".

The ADF operates automatically to feed forward the documents mounted in the document mounting section for positioning it in position on the upper surface of the document table of the machine and discharging it when necessary upon completion of a document copying operation.

In the case of a book or a like document unsuitable for automatic document feeding, the document carrier section made integral with the cover is opened in advance. And then, the document is placed manually in position on the document table for execution of the copy-making job.

In the case of a copier which is fitted with such ADF, the machine operation is not limited only to that described above but also to the utilization of the document size detectional function of ADF for supplying information necessary for the drive of automatic paper selection, automatic magnification rate selection and/or the like operations. As an example, in the case of automatic paper selection operation, necessary paper size selection can be automatically made, based upon the document size and size-enlargement or -reduction rate presetting. Further, in the case of automatic magnification factor selection operation, once upon setting of a paper size, an optimum magnification factor in correspondence therewith can be automatically selected out.

In the case of conventional copiers fitted with ADF of the above kind, automatic paper selection operation and manual paper selectional operation are executed by operation of two independent keys. As an example, when the ADF mechanism has been brought into an operative state, automatic paper selectional function may naturally be had, by utilization of the document size detectional function of ADF. On the contrary, when the ADF mechanism has been brought into an inoperative state, necessary paper size selection must be made by manipulation of a manual paper selectional function key. However, in this case, the key must be operated rather numerously for the desired selection job. Therefore, the number of key operations until select-out of the user's most frequently utilizing paper size may be completed in a rather numerous manner, which constitutes, indeed, generally a highly troublesome problem in the art.

SUMMARY OF THE INVENTION

It is, therefore, an object of the present invention to provide an improved paper size selection apparatus capable of selecting out the desired paper size by simple operation.

It is another object of the present invention to provide a paper size selection apparatus by which a first means for selecting a paper size according to an automatic paper selection function, a second means for selecting a paper size according to a preferential paper selection function and a third means for selecting a paper size according to a manual paper selection function are called in operative in succession and in rotation by key manipulation.

These and other objects are achieved by a paper size selection apparatus which includes means for automatically determining a paper size to be used for copying from the size of the document as well as the magnification factor; memory means for storing a paper size to be preferentially utilized; a key input means for inputting a manual instruction as to paper size selection; and control means for activating one of an automatic paper selection by use of the determination means, a preferential paper selection by use of the memory means, and a manual paper selection, in succession and in rotation in response to each instruction of the key input means.

These and other objects or features of the present invention will become apparent from the following description of a preferred embodiment thereof taken in conjunction with the accompanying drawings.

BRIEF DESCRIPTION OF THE DRAWINGS

In these drawings, same reference numerals or same symbols illustrate same or similar parts.

DETAILED DESCRIPTION OF THE PREFERRED EMBODIMENT

Figure 1:
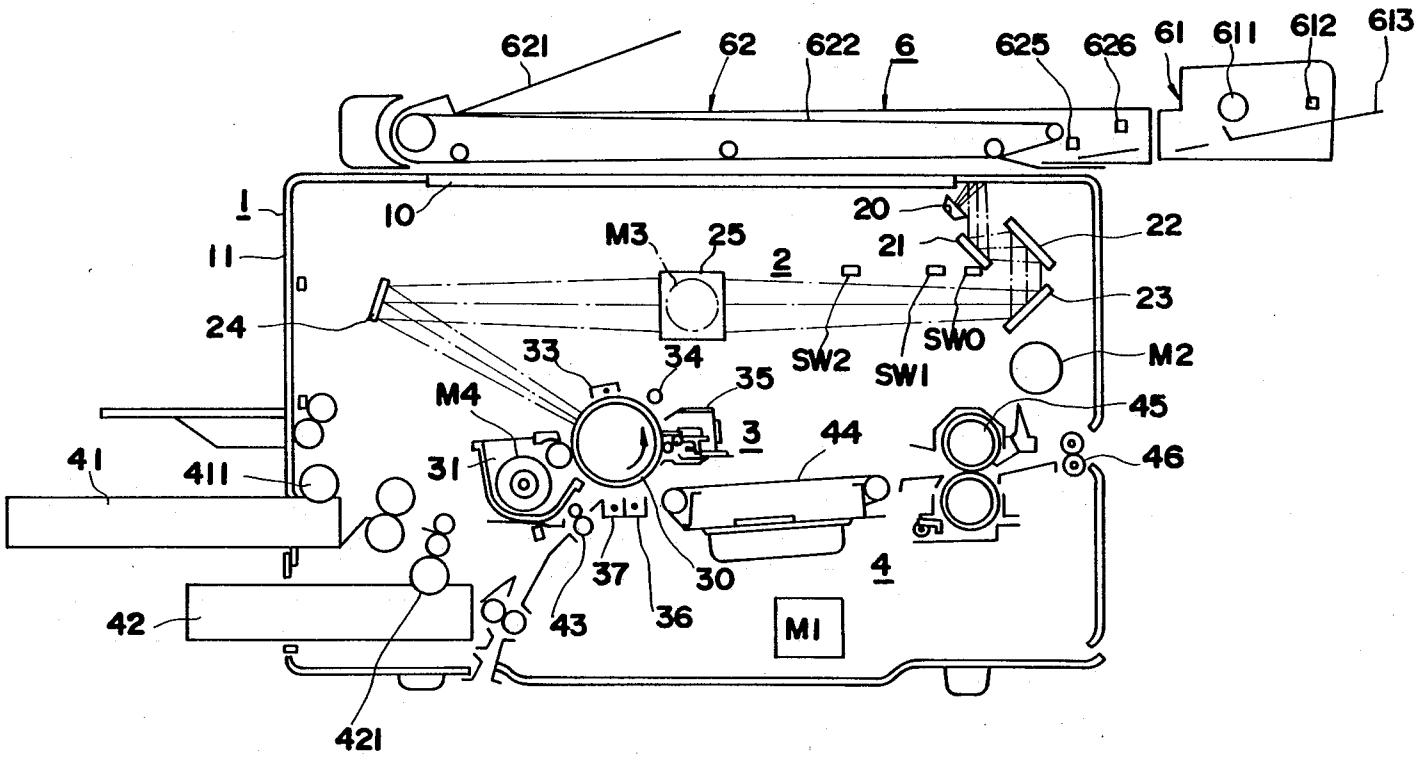
FIG. 1 is a schematic outline and structural view of a copier machine fitted with an embodiment of the paper size selection apparatus according to the invention.

FIG. 1 is a schematic structural arrangement view of a copier machine fitted with a preferred embodiment of the paper size selection apparatus of the present invention.

In this drawing, numeral 1 represents a machine main body and 2 denotes generally a scanning system which is adapted for transmitting optical images provided by conventional exposure operation of a document and is positioned within the interior space of the main machine body 1. The scanning system 2 comprises an exposure lamp 20; first mirror 21; second mirror 22; third mirror 23; fourth mirror 24; magnification factor setting lens 25 and the like.

Numerals 3 represents an image formation system for reforming the images transmitted from the scanning system 2 on the paper through the way of electrophotographing process, comprising a photosensitive drum 30, a developing unit 31, a charger 33, a main eraser 34, a cleaning blade 35, separation charger 36, a transfer charger 37 and the like.

Numeral 4 represents a paper feed and discharge system adapted for execution of paper feed, image fixing and paper discharge, comprising an upper paper feed tray 41, a lower paper feed tray 42, a timing roller pair 43, a suction belting 44, an image fixing roller pair 45, a paper discharge roller pair 46, paper delivery rollers 411 and 421 and the like.

Within the interior space of machine main body 1 comprising a glass-made document desk or table 10 and a hollow housing 11, there are arranged scanning system 2 scanning the images on the document, not shown, and projecting the scanned images, image-reproduction system 3 adapted for reproducing the thus projected images on papers through the way of conventional electrophotographing process, and paper feed and discharge system 3 for feeding copy papers and for discharging the image-formed and fixed papers.

Numeral 6 represents ADF which comprises a document mounting section 61 and a document transporting section 62. Document mounting section 61 comprises a document sensor 612, a document paper feed roller 611 and a document tray 613. The sensor 612 senses if there is/are document(s) on tray 613 or not, while the roller 611 will feed the documents forward one by one.

The document transporting section 62 covers document supporting glass or more specifically document table 10 and acts to receive the document fed in by the feed roller 611 through document transporting belt 622 onto document table 10 and brought into halt at specific ready-for-use position provided thereon.

The section 62 is formed at its central portion with an openable and reclosable cover, although not shown. By raising in front portion thereof upwards, document table 10 is exposed and thus, the user can place the document manually thereon, if necessary. Numeral 626 represents document paper detecting sensor, arranged between document-mounting section 61 and the transporting belt 622, for inspection of the transporting state of the document to thereby detect the size of the document. In the similar way, there is arranged in proximity of the said cover a further sensor 625 which senses opening or closure thereof.

Main motor M1 is provided to drive said image formation system 3, paper feed and discharge system 4 and the like. M2 represents a further drive motor which is adapted for driving the scanning system 2. A further drive motor M3 is provided for setting the magnifying factor by displacing magnification factor-setting lens 25. There is provided a still further drive motor M4 for functioning the developing unit 31.

Since general structure and copying operations of the foregoing copier machine per se are already and commonly known, there will be set forth only briefly, and so far as they are concerned with the inventive apparatus under consideration.

Figure 2:
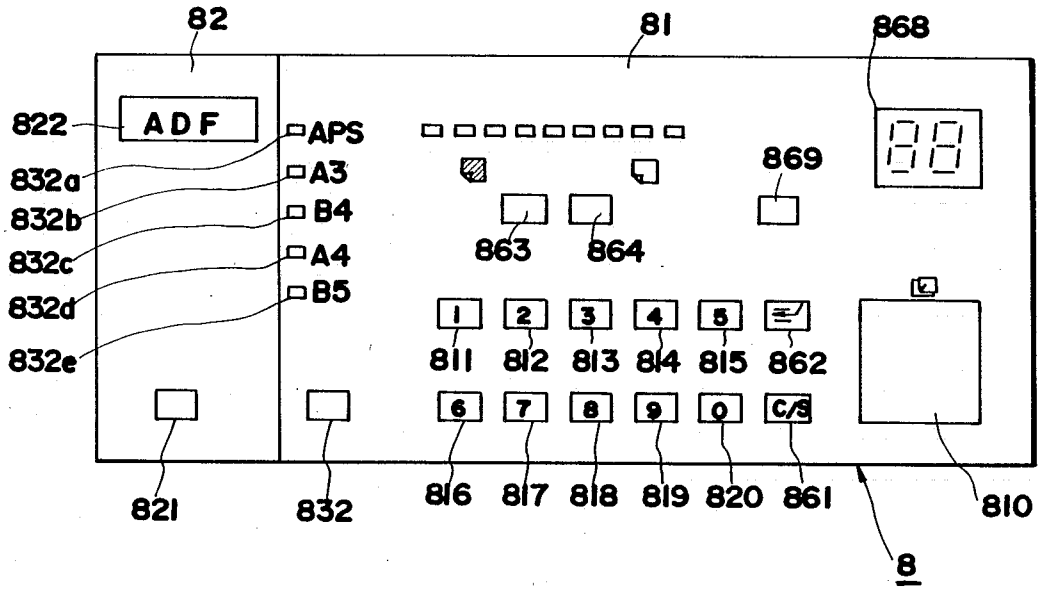
FIG. 2 is a top plan view of an operation control panel fitted on the upper surface of the copier main body shown in FIG. 1.

FIG. 2 is a top plan view of an operation control panel 8 mounted on the upper surface of the machine body 1 shown in FIG. 1. In this copier machine, the control operation of ADF 6 can be executed on the control panel 8.

The panel 8 is generally subdivided into machine control section 81 and ADF control section 82. Print start key 810 serves for initiation of the copying job. Ten keys 811–820 serve for designation of the number of scheduled copying sheets and the magnification factor. Interruption key 862 serves for interferringly introducing one or more of new sheets amidway during execution of copying a preparatorily scheduled sheets of copy paper. On the other hand, clear stop key 861 serves for clearing the information on numeral display 868, when necessary. By operation of paper selection key 832, paper selections are displayed successively in rotation at several display LEDs. For this purpose, more specifically, LED 832*a* for APS selection display; LED 832*b* for A3-selection display, LED 832*c* for B4-selection display; LED 832*d* for A4-selection display and LED 832*e* for B5-selection display are provided as shown.

Up-key 863 and down-key 864 represent exposure keys for stepwise modifying and specifying the image density and, for this purpose, fitted with a row of LEDs for displaying image density variations.

All reset key 869 serves for resetting various operating parts of the copier machine under consideration to the initial state.

Preferential size memory key 821 acts upon manipulation thereof to acknowledge the presently displayed paper size as preferential for setting in preferential memory.

At ADF-control section 82, there is provided ADF-mode display LED 822 which displays the document paper feed being ready for executing automatically under the action of ADF. ON-state of this LED 822 shows the ADF is ready for such use.

Figure 3:
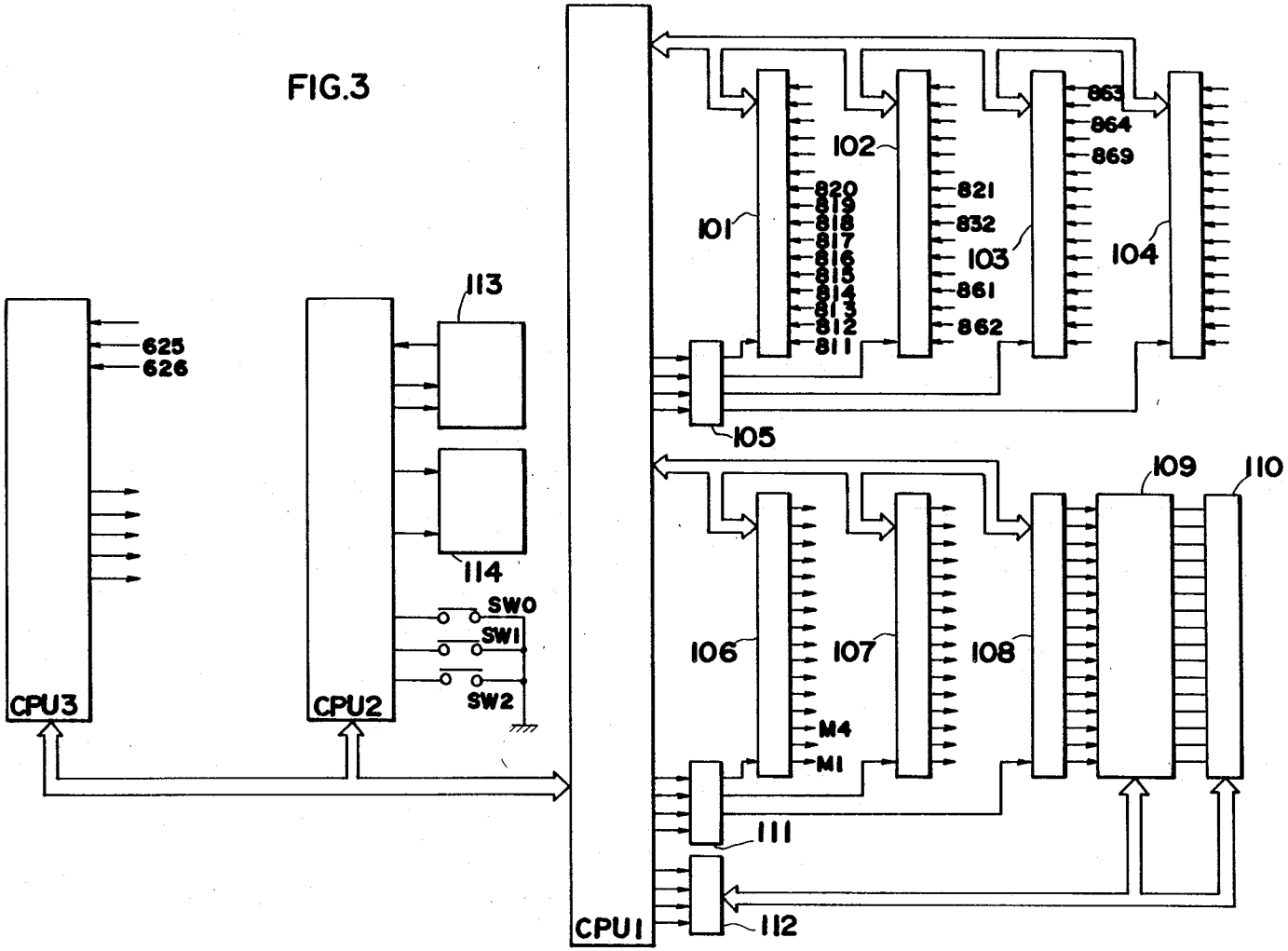
FIG. 3 is a block diagram showing control circuits of the copier machine fitted with the embodiment of the paper size selection apparatus according to the invention.

FIG. 3 is a block diagram of the control circuit of the copier machine fitted with the paper size selection apparatus designed and arranged according to a preferred embodiment of the present invention.

In this drawing, first microcomputer CPU1 acting as host computer which is electrically connected through respective interrupt terminals and data input and output terminals with second and third microcomputers CPU2 and CPU3. First microcomputer CPU1 is electrically connected with input/output expansion ICs (preferably Intel-made 8423) 101–104 which are controlled as input expansion IC controlled by decoder 105, and further connected through these expansion ICs 101–104 to ten key group 811–820 on said operation control panel 8, as well as sensor group arranged in paper feed and discharge system 4. Further, output expansion ICs 106–108 using said input/output expansion ICs controlled through decoder 111 and acting for output service, are connected with main motor M1; main motor of ADF; clutch of timing rollers 43; clutch of paper feed roller 421; respective drivers of charger 33, transfer charger 37 and separation charger 36 and the like. Further, CPU1 is connected through decoder 112 with the drivers of LED group 110 (832*a;* 832*b;* 832*c;* 832*d;* 832*e* etc.) for ignitingly displaying ON-state at operation control panel 8 as well as those of displaying circuit 109 of display section 868 adapted for numeral displaying.

As may be well understood from the foregoing, first microcomputer CPU1 will control main operations of the copier machine as well ADF, such as those of the driving of image-forming system 3, paper feed and discharge system 4, display section of operation control panel 8, temperature adjudgement and in the like, and indeed, depending upon the ten key inputs or sensor inputs.

Second microcomputer CPU2 is electrically connected to switches SW0–SW2 arranged at scanning system 2 for detecting the image leading end; to scan motor control circuit 113 including driver and the like of exposure scanning motor M2; and to magnification factor modifying lens control circuit 114 including driver and the like of magnification factor setting motor M3 including a stepping motor per se and the like.

As will be noted from the foregoing second microcomputer CPU2 will control the drive of exposure scanning motor M2 and magnification factor setting motor M3, depending upon the instructions from first microcomputer CPU1, and generate necessary signals including timing signal and the like, depending upon on/off of switches SW0–SW2 arranged at the scanning system 2 and adapted for detection of the image leading end, as well as sensor inputs and the like, not shown.

Third microcomputer CPU3 is used for control of the drive motor for document paper feed roller 611 at document mounting section 61, and of ADF with which several sensors including a sensor 626 arranged at ADF and serving for document paper detection and a further sensor 625 adapted for sensing cover opening/closing state.

Figure 4:
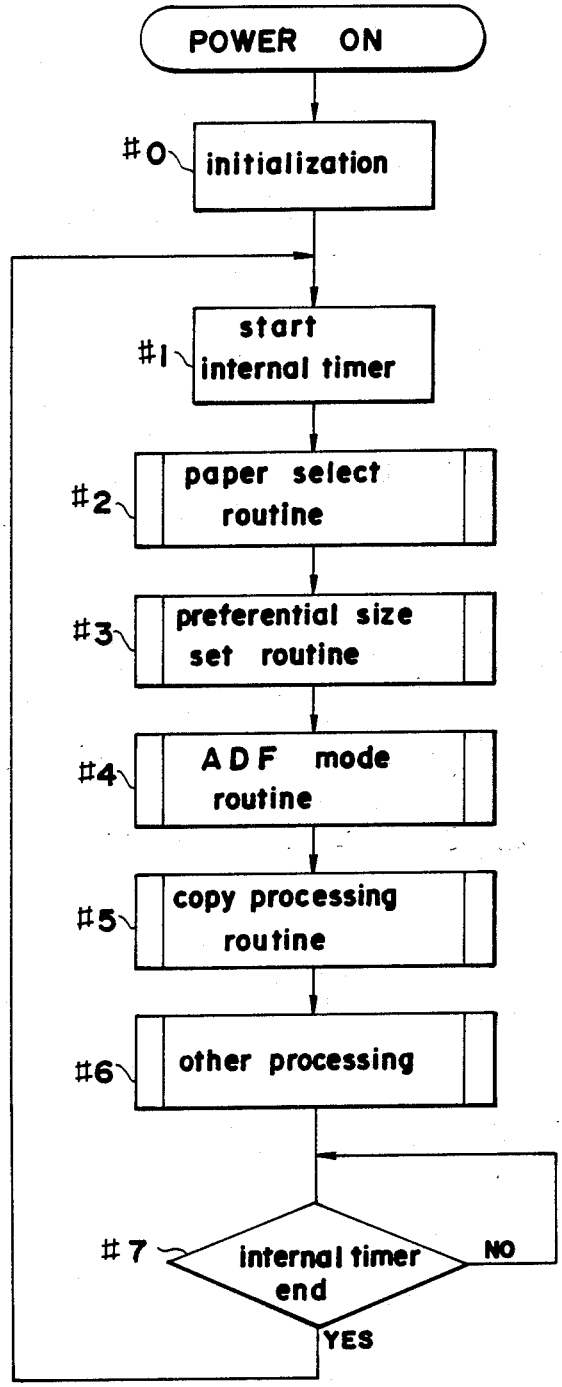
FIGS. 4–10 are several flow charts, illustrating copier control operations of the copier machine fitted with the paper size selection apparatus according to the invention.

FIG.4 represents a flow chart of main routine for the control of first microcomputer CPU1 of the copier machine, as an example, fitted with the paper size selection apparatus according to a preferred embodiment of the present invention.

Firstly, at first step #0, power source is turned ON, then initial setting is brought about. At next step #1, an internal timer is caused to start for presetting the time period necessary for completion of one main routine. Then, at the next succeeding step #2, "paper selection routine" to be described is called for, and at still next further steps #3, #4, #5, #6 and #7, "preferential size setting routine", "ADF-mode routine", "copy operation routine", "other processing routine" which has been omitted from the description herein, are succeedingly called for and finally, the internal timer will become timed up for completion of one routine under consideration.

The time duration for this one routine is utilized to execute counting jobs of various timers to be used in the foregoing various routines. More specifically, these various timers are adjudged each to become time-upped by completion of several operating times especially allocated to each of these timers.

Figure 5:
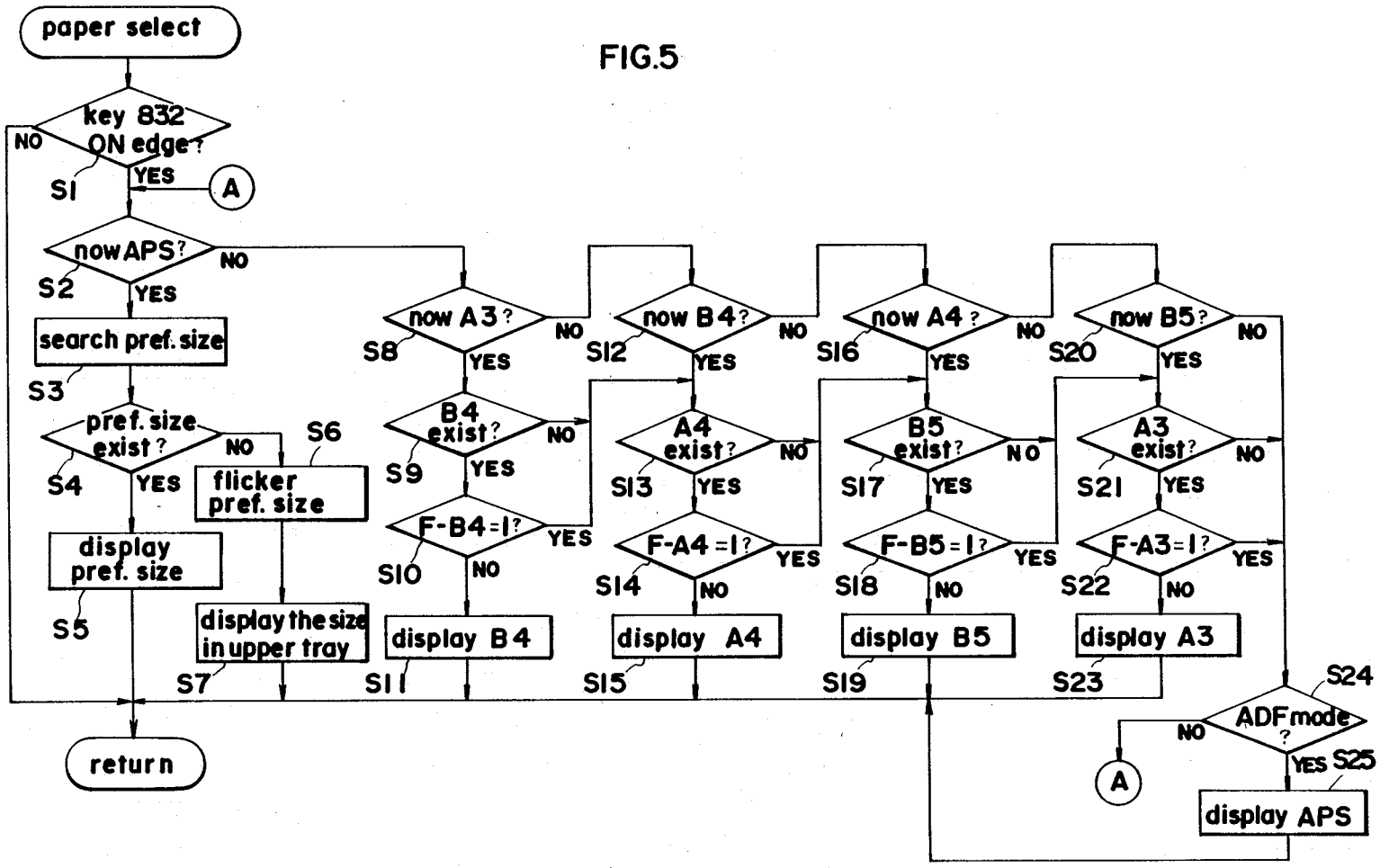

Data communications made from the side of first microcomputer CPU1 which is the host computer to second and third microcomputers CPU2 and CPU3 are executed upon completion of each routine processing, by occasional interrupt demand(s) from the first microcomputer CPU1, and indeed, independently of the main routine processing. FIG. 5 is a flow chart showing details of the "paper selection routine" at said step #2.

In this routine, by operation of paper selection key 832, LED 832*a* for APS display of paper selection display LEDs, and one of LED 832*b* for A3-display, LED 832*c* for B4-display, LED 832*d* for A4-display and LED 832*e* for B5-display will in consideration with the preferential paper size selection be successively changed over. It should be noted that by initial setting at the time of energization by the power source, an initialization is introduced, so as to select out APS-mode.

At first, in step S1, ON-edge of paper selection key 832 is to be adjudged. If the ON-edge does not arrive, this routine is made out of service. When, at step S1, the ON-edge of paper selection key 832 is adjudged to arrive, then, it is adjudged at next step S2 that APS is presently in setting and LED 832*a* for APS-display is ON or not. If APS-mode has been selected out at the initialized state and LED 832*a* for APS-display is ON, then, at step S3, by processing of "preferential paper size setting routine", the preset paper size is searched, and, at next further step S4, it is adjudged if the preferential paper size preset by the corresponding "preferential paper size setting routine" does concern either with the upper stage paper feed tray 41 or with the lower stage paper feed tray 42. If the preferential paper size does concern, proper one of LEDs consisting of LED 832*b* for the display of preferential paper size A3; LED 832*c* for the display of B4; LED 832*d* for the display of A4 and LED 832*e* for the display of B5 is made ON.

On the contrary, if preferential paper size is adjudged as not prevailing at step S4, preset one of those LEDs which consist of LED 832*b* for the display of A3; LED 832*c* for the display of B4; LED 832*d* for the display of A4 and LED 832*e* for the display of B5, the preset paper size being not available at upper or lower paper feed tray 41 or 42, is made at step S6 to flicker for displaying inadequate selection, and further at step S7, proper LED for the specified paper size corresponding to papers accommodated in upper paper feed tray 41 (or in lower paper feed tray 42) is made ON for displaying thereof and to specify it. When, at step S2, LED 832*a* for the APS-display is adjudged not ON, where, for example, at step S1, ON-edge of paper selection key 832 was sensed several times, it is adjudged further, at step S8, A3-paper size has been set and LED 832*b* for A3-displaying is ON or not. When this LED 832*b* for A3-displaying is ON, it is adjudged at step S9 that if B4-paper size is available in upper or lower paper feed tray 41 or 42, and when B4-paper size is available, it is adjudged that if B4-paper size is being treated as preferential paper size by observing B4-preferential flag to adjudge if the flag is erecting or not. Or more specifically, when B4-paper size being treated as preferential one, the preferential paper size of B4-paper has been adjudged at steps 3, 4, 5. Therefore, only when B4-paper size is not preferenced, it is necessary at step S11 to make LED 832*c* for the display of B4-paper size ON, is order to set the B4-size.

Further, at step S8, if A3-paper size has not been set in, and A3-display LED-832*b* is OFF, then, at step S12, it is adjudged if B4-paper size has been set in and B4-display LED 832*c* is ON or not. When the B4-display LED 832*c* is ON, or B4-paper size is adjudged as not available at step S9, or at step S10, B4-paper size is adjudged as preferential, it is adjudged at step S13, A4-paper size is adjudged as available in upper or lower paper supply tray 41 or 42, and if A4-paper size is available, it is adjudged at step S14 if A4-paper size is being treated as preferential one or not by observing A4-preferential flag. If A4-paper size is not being treated as preferential one, A4-display LED 832*d* for A4-paper size is made ON at step S15 and A4 is set in.

And then, if at step S12, B4-paper size has not been set in and B4-display LED 832*c* is OFF, it is adjudged at step S16, if A4-paper size has been set in and A4-display LED 832*d* is ON or not. When A4-display LED 832*d* is ON, or at step S13, A4-paper size is adjudged as unavailable, or at step S14, A4-paper size is adjudged as preferential one, it is adjudged at step S17, if B5-paper size is available at upper or lower paper feed tray 41 or 42. When B5-paper size is available, it is adjudged at step S18, if B5-paper size is being treated as preferential one or not, by observing B5-preferential flag. When B5-paper size is not being treated as preferential one, B5-display LED 832*e* for B5-paper size is made ON at step S19 and thus it is displayed and set in.

Further, at step S16, if A4-paper size is not set in and A4-display LED 832*d* is OFF, it is adjudged at step S20, if B5-paper has been set in and B5-display LED 832*e* is ON or not. When B5-display LED 832*e* is ON, or, at step S17, B5-paper size is adjudged as un-available, or at step S18, B5-paper size is adjudged to be preferential one, A3-paper size is adjudged at step S21 as available at upper or lower tray 41 or 42. When A3-paper size is available, it is adjudged at step S22 if A3-paper size is being treated as preferential one by observing A3-preferential flag. When A3-paper size is being treated not as preferential one, A3-paper size display LED 832*b* is made ON at step S23, for displaying and setting-in thereof.

Further, at step S20, B5-paper has not yet been set in, thus B5-display LED 832*e* being OFF, or, at step S22, A3-paper size is adjudged as unavailable, or, at step S22, A3-paper size is adjudged to be preferential one, it is adjudged at step S24 if ADF-mode is usable or not. When ADF-mode is usable, APS-mode display LED 832*a* is made ON, thereby this mode being displayed and set in. On the contrary, at step S24, when ADF-mode is not usable, processings at step S2 will be executed.

As may be well noted, in the foregoing flow chart, paper selection by APS-mode; paper selection with preferential paper size and A3-paper, B4-paper, A4-paper and B5-paper, however, with exception of that paper size which has been preferentially selected out, if any, will be successively subjected to selection in rotation manner. Since, however, in practice, and in the case of the present embodiment of the invention, upper and lower paper feed trays 41 and 42 are almost always charged with papers and either one size of these stored papers is generally specified as preferential for being most frequently selected out and used, and thus after all, paper selection in APS-mode; that of preferential mode and paper selection for one size from the group consisting of A3-paper, B4-paper, A4-paper and B5-paper, however, with exception of the one occasionally and mostly specified as preferential paper size, are subjected to selection in effect and after all in three stage size selections.

Figure 6:
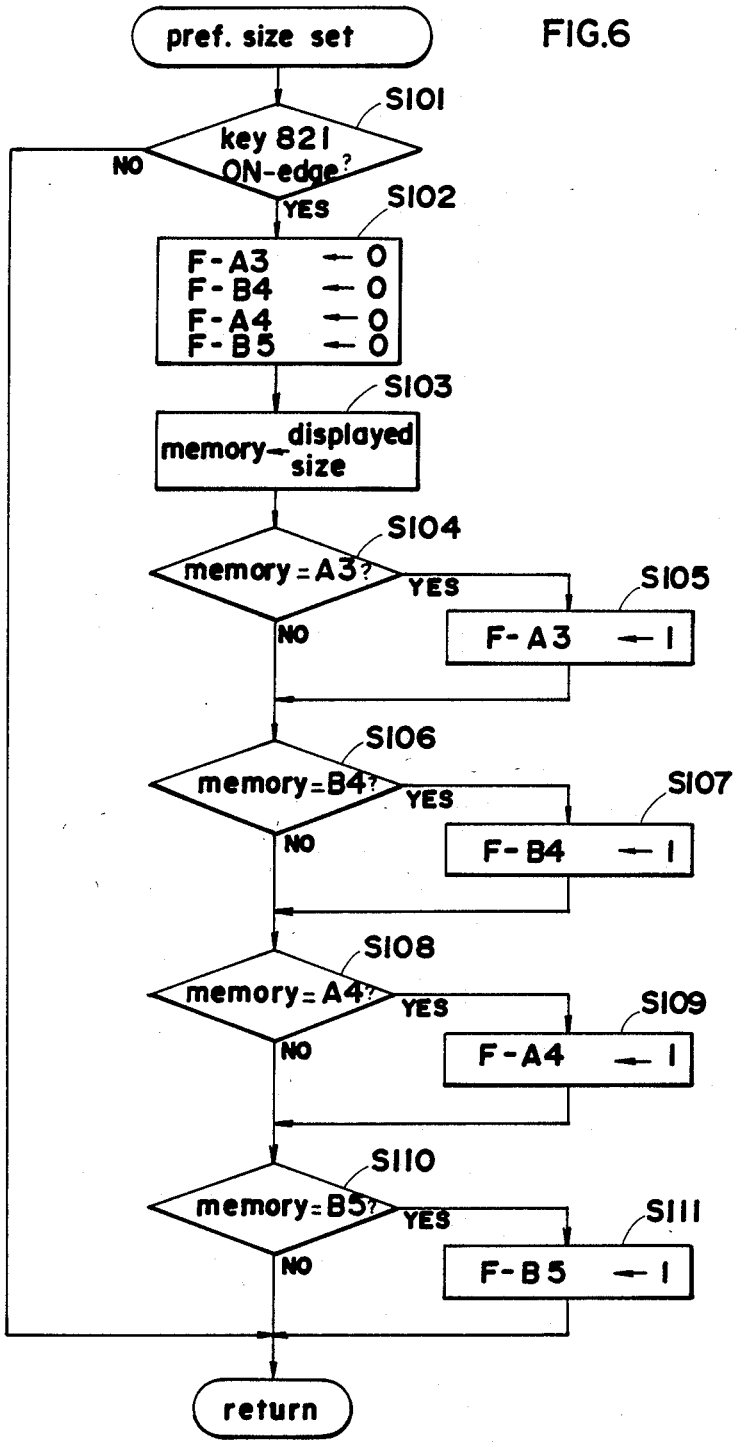

FIG. 6 is a detailed flow chart of "preferential size setting routine".

In this routine, a paper size is set as that to be preferentially selected after releasing of APS-mode. It should be noted that the paper size selected out at the present stage is stored in a form of flag by operation of paper selection key 832, so as to avoid otherwise occuring double or overlapped selection.

Firstly, at step S101, ON-edge at manipulation of preferential size memory key 821 is adjudged. If such edge should fail to arrive, the present routine is made ineffective. On arrival of such edge, at step S102, A3-, B4-, A4- and B5-preferential flags are lowered and the paper size presently displayed paper size at S103 is treated as preferential one and set into the preferential memory. At step S104, if the preferential paper size stored in the preferential memory is adjudged to be A3-paper size or not. If it is A3-paper size as adjudged, A3-preferential flag is erected at step S105 in the similar way, it is adjudged at step S106 if the preferential paper size is B4-one or not. If it is B4-paper size, B4-preferential flag is erected at step S107. At step S108, it is adjudged if the preferential paper size is A4-one or not. When it is A4-one, A4-preferential flag is erected at step S109. Further, at step S110, preferential paper size is adjudged to be B5-paper size or not. If YES, B5-preferential flag is erected at step S111.

In this way, and by operation of preferential memory key 821, the currently displayed paper size is taken as preferential paper size and set in the preferential memory. And then, a flag corresponding to the preferential paper size stored in the preferential memory is erected and kept in this state.

Figure 7:
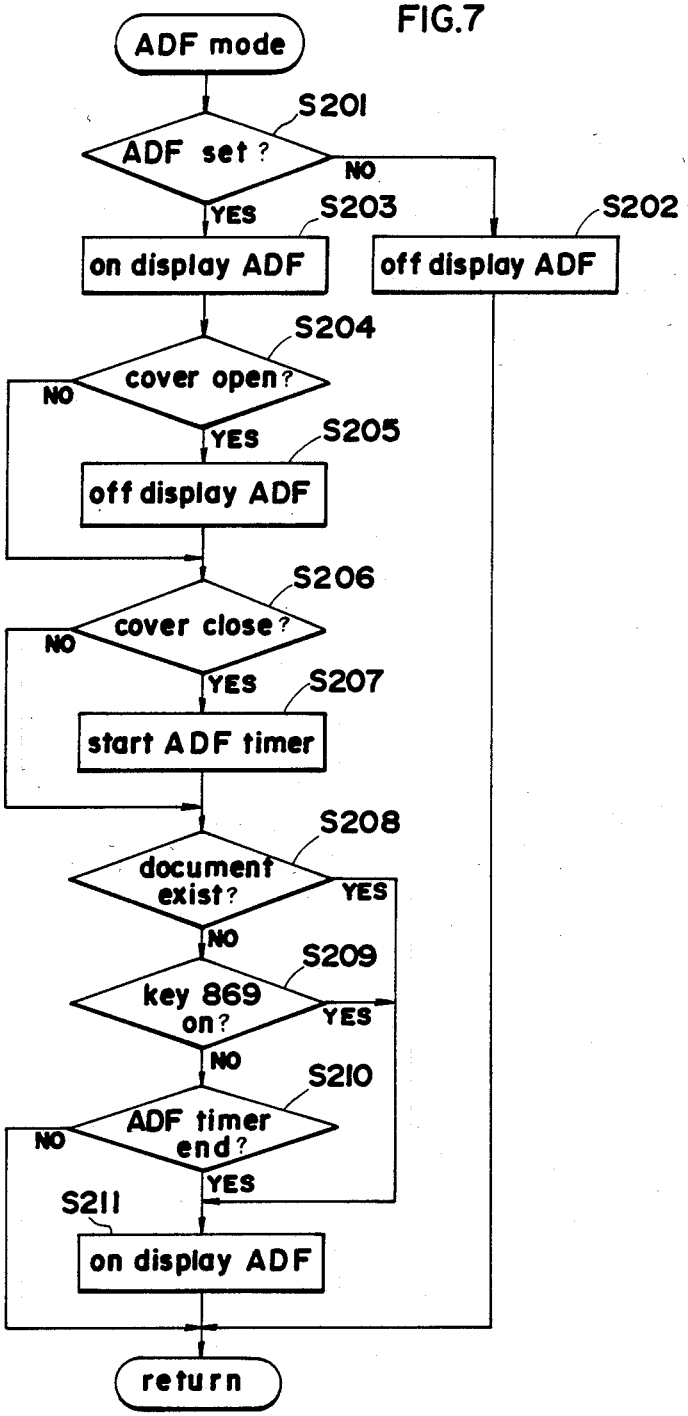

FIG. 7 is a detailed flow chart showing "ADF-mode routine" at the foregoing step #4.

This routine serves for making LED 822 for displaying ADF-mode ON and demonstrates that the copier machine is fitted with ADF 6 and the latter is operative.

More specifically, it is adjudged at step S201 if the copier machine has been fitted with such ADF. If the machine has not been fitted with ADF 6, LED 822 serving for displaying ADF-mode is made OFF at step S202. On the contrary, if ADF has been fitted with ADF 6, LED 822 is made ON at step S203 for demonstrating the ADF-mode. Next, at steps S204, S206, if the openable cover at the transporting station 62 of ADF 6 is adjudged open or closed. When the cover opening is sensed by sensor 625 serving for this purpose, LED 822 serving for displaying ADF-mode is made OFF at step S205. With the cover closed, the fact is adjudged at step S206 and a ADF-timer serving to provide a timing for entering into ADF-mode is caused to start at step S207.

When document-detecting sensor 612 senses at step S208 that the document is present in tray 613, or all reset key 869 is operated to input at step S209, or ADF-timer is timed up at step S210, ADF-mode display LED 822 becomes ON at step S211.

Figure 8:
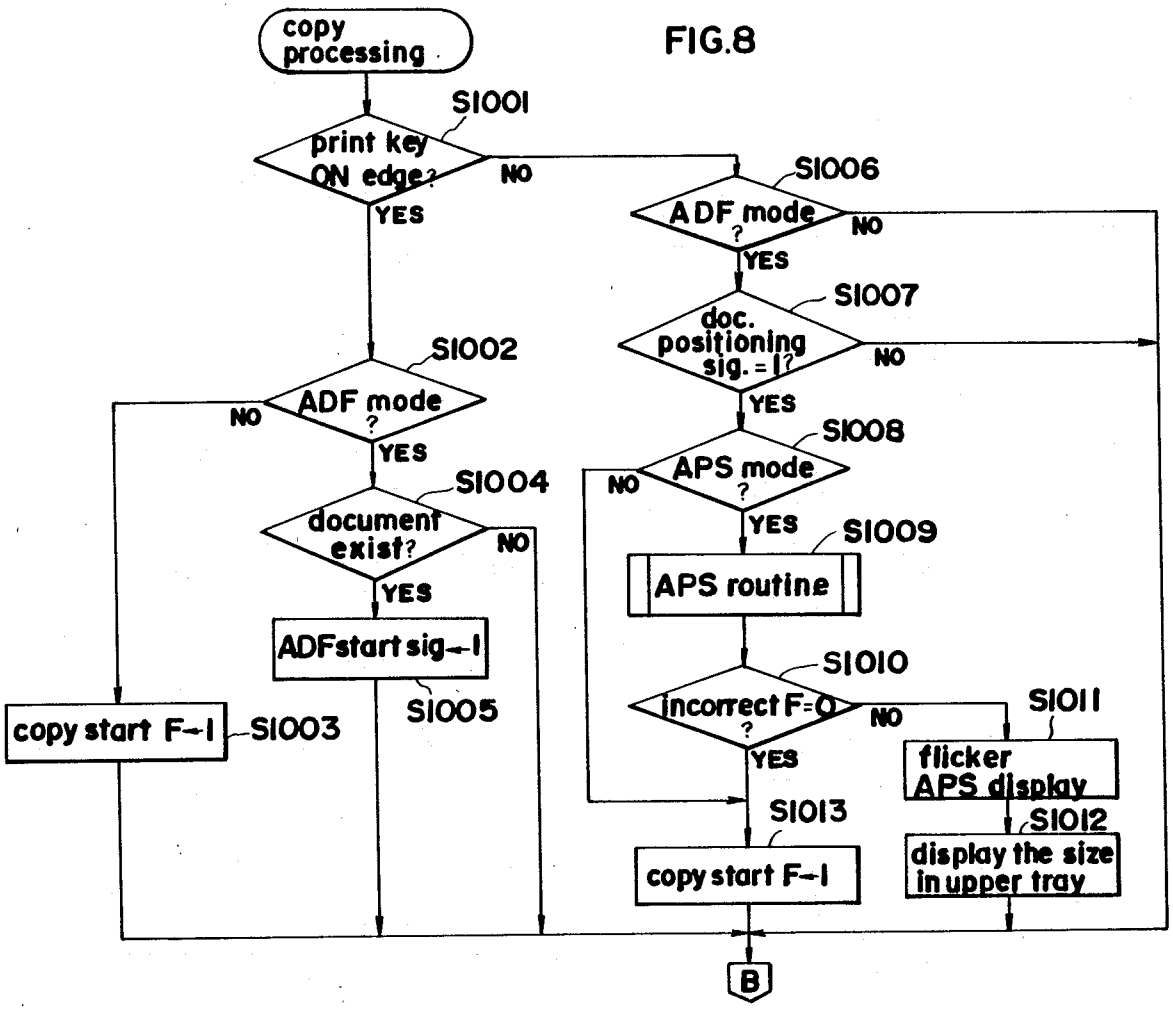
Figure 9:
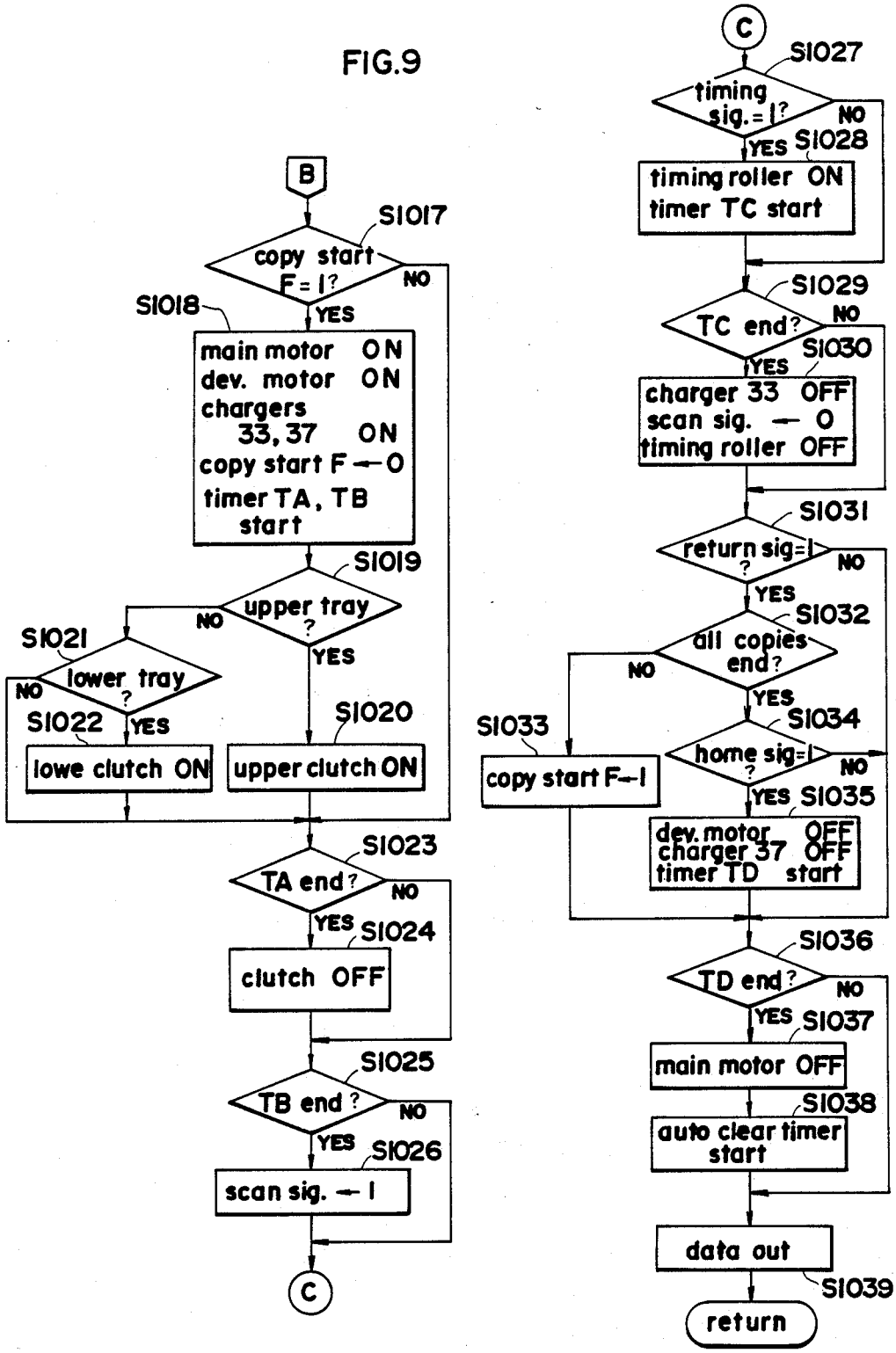

FIG. 8 is a detailed flow chart of "copying operation routine" at said step #5.

In this routine, print start key 810 is operated for execution of the copy-making job on the copy paper.

At first, at step S1001, ON-edge of print start key 810 is adjudged. With arrival of ON-edge signal, ADF-mode is adjudged at step S1002 to be effective or not by observing the ADF-mode display LED 822. When ADF-mode is ineffective, copy initiation flag is erected (to binary "1" position) at step 1003 since the operator has placed manually a document on document table 10. On the contrary, in the case of ADF-mode effective, if there is document or not in the document tray 613 by observing document sensor 612 at step S1004. If YES, ADF-start signal is made to binary "1" at step S1005, for feeding it to second microcomputer CPU2. With this feed of said ADF-start signal "1", second microcomputer CPU2 will execute a document control job and ADF 6 will start the paper feed of the document mounted on document mounting section 61.

On the other hand, even if, there is no ON-edge of print start key 810, it is adjudged at step S1006 if ADF-mode is effective or not. If, ADF-mode is effective, it is adjudged, at step S1007, if document positioning signal of second microcomputer CPU2 is binary "1" or not. Additionally, this signal is that which was made to binary "1" under the document paper feed treatment control action by ADF 6 when the document was correctly brought to position on the document table. When the positioning signal is binary "1", it is adjudged at step S1008 if automatic paper selection mode is set or not by observing LED 832*a* being ON or not. When automatic paper selection mode is set, "automatic paper selection routine" to be described after is called for at step S1009.

Then, at the next succeeding step S1010, it is adjudged if incorrect size flag is at down position (binary "0") or not. In this "automatic paper selection mode", the said flag will become binary "1", when there is no correct size copy paper, corresponding to the size of the document, in the upper or lower paper tray, 41 or 42. If the incorrect size flag is in erected position, APS-mode display LED 832*a* is made to flicker at step S1011 and the paper size in upper stage tray 41 is displayed at step S1012 and set in.

If the incorrect size flag is found at its down position, or at step S1008 automatic paper selection mode is off service, the copy initiation flag is erected at step S1013.

Next, at step S1017, the state of copy-initiation flag is adjudged. When this flag is found to be in erected state, main motor M1, motor M4 for developing unit 31, charger 33 and transfer charger 37 are respectively ON at step S1018. Further, the copy initiation flag is brought to its down position and timers TA and TB are brought to start, thereby the copier machine being brought into operation. The timer TA serves for setting the OFF-time of clutches of paper feed rollers 411, 421 for upper and lower trays 41, 42, while the timer TB serves for setting of the scanning initiation time.

At next step S1019, it is adjudged if upper paper feed tray 41 has been selected out. When this tray 41 has been set, clutch of the related feed roller 411 is made ON at step S1020. At step S1021, it is adjudged if the lower paper feed tray 42 has been set in or not, and when YES, the clutch of lower paper feed roller 421 is made ON at step S1022. And, at step S1023, progress at timer TA is adjudged. When the set time of timer TA has become up, clutches of paper feed rollers 411, 421 become OFF at step S1024, thereby the copy paper feeding service being terminated. Further, at step S1025, the progress at timer TB is adjudged, and upon timing-up thereof, the scan signal (scanning initiation signal) fed at step S1026 to second microcomputer CPU2 is set to binary "1". It may well be noted that this second microcomputer CPU2 will initiate exposure scanning operation upon reception of the said signal.

When the scanning system 2 has reached at a predetermined position at step S1027, timing signal delivered from second microcomputer CPU2 is adjudged. If it is detected that the said timing signal is binary "1", the clutch of timing roller 43 is made ON at step S1028, thereby a copy paper being fed to between photo-sensitive drum 30 and transfer charger 37, for execution of the transfer job relative to the presently fed-in copy paper. Further, timer TC will start. This timer TC serves for to set the operation termination time, the charging time and the clutch-OFF time of the timing rollers 43. This set time is defined by the copy paper size preset at steps 1019–1022 as well as preset copy magnification factor.

At step S1029, time-up of timer TC is adjudged. When the setting time at timer TC has been consumed up, then, at step S1030, charge 33 becomes OFF; scanning signal is turned to binary "0"; and clutch of timing rollers 43 becomes OFF. Further then, at step S1031, return signal fed from second microcomputer CPU2 is adjudged as "1" or not. When the return signal fed out at step S1031 from second microcomputer CPU2 is adjudged to be "1" or not. When the return operation has been initiated and the return signal is "1", termination of multi-copying is adjudged at step S1032 and when the return of scanning system 2 to the reference or basic position is adjudged at step S1034, a reference position signal "1" delivered from second microcomputer CPU2 will cause, at step S1035, to make drive motor M4 for developing unit 31 OFF and also transfer charger 37 OFF, while timer TD is set in. On the other, when multi-copying operation is not brought into termination, the copy initiation flag is at step S1033 re-erected (making to "1"). And awaiting for time-up of timer TD at step S1036, main motor M1 is made OFF at step S1037. And further, at step S1038, an automatic clearing timer is caused to start and then, at step S1039, several control signals for outer instruments and the like are delivered. The automatic clearing timer, when the time period thereof has elapsed, causes all parameters for copying to clear in the initial status. According to this operation, the paper size selection mode is also set in the APS-mode. In this way, copying operation is executed.

Figure 10:
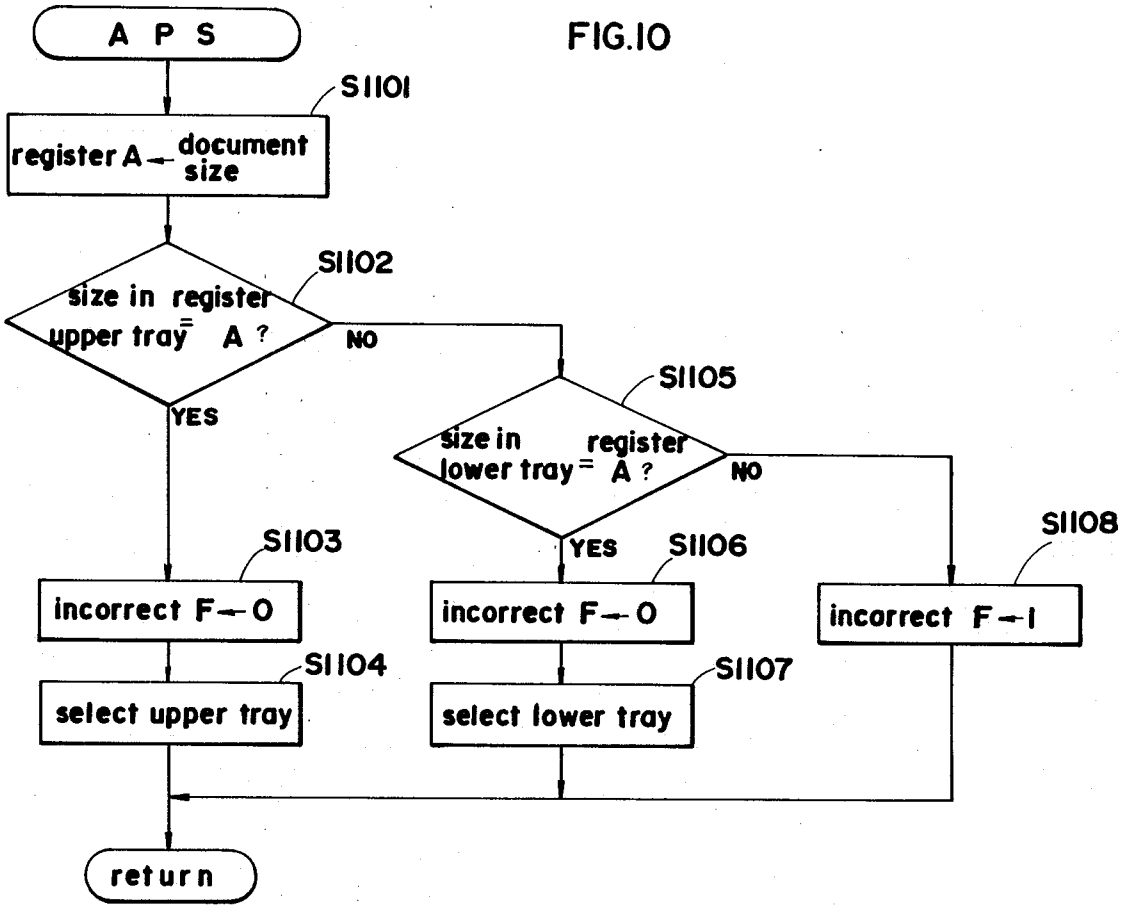

FIG. 10 is a detailed flow chart of "automatic paper selection" at step S1009.

This routine serves for executing an automatic selection of usable copy paper in correspondence to the size of document.

At step S1101, the size of document is detected by the sensor 626 and the thus obtained document size data is introduced into a register A for being stored therein. Further, at step S1102, the paper size found at upper paper feed tray 41 is compared with the paper size data stored at the register A for adjudging correspondency between the both.

If there is coincidence between the both sizes, the incorrect size flag is brought at step S1103 to its lowered position (signal being "0") and at step S1104, upper (stage) paper feed tray 41 is specified.

Further, if, at step S1102, there is uncoincidence between the both sizes, it is adjudged at step S1105 that the paper size at lower stage paper feed tray does coincide with that stored at the register A or not, and if there is coincidence between the both, incorrect size flag is lowered at step S1106 (to show the signal "0"). Then at further step S1107, the lower stage paper feed tray 42 is designated. Further, if the paper size stored at the register A is not in coincidence with that available either trays 41 or 42, the said flag is erected at S1108 (bringing the signal to "1").

As may be well understood from the foregoing description, the paper size selection apparatus carries out three paper size selection modes, namely, the automatic paper selection mode, the preferential paper selection mode and the manual paper selection mode. These three modes are so arranged to be select in succession and in rotation by manipulation of a single key, so that the number of operation keys can be reduced to a possible minimum.

Since the automatic paper selection mode is initially selected at the time of energization by the power source or after the lapse of the time set in the automatic clearing timer, the operator is firstly provided a full utilization possibility of the copier machine performance.

If the ADF-function is kept aside or omitted, the operator can freely select a preferred paper size by key manipulation with the preferential selection of most frequently utilized paper size, to thereby reduce the number of keying operations to a substantial degree.

The document size discrimination is executed by the sensor 626 attached to ADF in the embodiment. However, it is not limited in the practice of the present invention only to such that which discriminate the document size by ADF. As an example, it may be such means which is capable of discriminating the document size at the side of copier machine main body.

In the embodiment, the manual paper selection after the preferential paper selection is executed so as to select the sizes except for the preferential paper size in succession and in rotation. It is also possible to add the preferential paper size to the rotation at the manual paper selection.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A paper size selecting apparatus for use in copier machines having a plurality of copier paper accommodating sections each of which accommodates papers of different size, said paper size selecting apparatus comprising:

means for automatically determining a paper size to be used for copying based on the size of a document to be copied and a selected magnification factor;

first means for selecting one of said paper accommodating sections according to the determining means;

means for designating a paper size to be preferentially utilized;

second means for selecting the paper accommodating section in which papers of the size designated by said designating means are accommodated;

third means for selecting one of said paper accommodating sections in which papers of a size different from the paper size designated by said designating means are accommodated;

a key for inputting an instruction to the third selecting means as to paper size selection; and means for causing one of the first, second and third selecting means to be progressively operable in this order in response to each manipulation of the key.

2. A paper size selection apparatus as claimed in claim 1, wherein the determination means includes a sensor device detecting the size of the document.

3. A paper size selection apparatus as claimed in claim 2, wherein the sensor device is disposed in an automatic document feed apparatus combined with the copier machine.

4. A paper size selecting apparatus as claimed in claim 1, further comprising:

first indicating means for indicating that said first selecting means is actuated; and second indicating means for indicating the size of paper presently selected.

5. A paper size selecting apparatus as claimed in claim 1, wherein said designating means includes means for setting the preferential paper size and memory means for storing the preferential size set by the setting means.

6. A paper size selecting apparatus as claimed in claim 1, wherein said third selecting means sequentially selects paper accommodating sections in a predetermined order in response to each manipulation of the key when there is set a plurality of paper accommodating sections with papers of a size different from the preferential size.

7. A paper size selecting apparatus for use in copying machines having a plurality of paper accommodating sections each of which accommodates papers of different size, said paper size selecting apparatus comprising:

means for automatically determining a paper size to be used for copying based on the size of a document to be copied and a selected magnification factor;

first means for selecting one of said paper accommodating sections according to the determining means;

means for designating a paper size to be preferentially utilized;

second means for selecting the paper accommodating section in which papers of the size designated by said designating means are accommodated;

third means for selecting one of said paper accommodating sections in which papers of a size different from the paper size designated by said designating means are accommodated;

a key for inputting an instruction to the third selecting means as to paper size selection; and means for causing the second paper selecting means to be selected when the operation of the first paper selecting means is released in response to manipulation of the key.

8. A paper size selecting apparatus as claimed in claim 7, wherein said designating means includes means for setting the preferential paper size and memory means for storing the preferential size set by the setting means.

* * * * *